US009713348B2

(12) United States Patent
Astin

(10) Patent No.: US 9,713,348 B2
(45) Date of Patent: Jul. 25, 2017

(54) RESILIENT PHALLUS RETENTION GARMENT WITH LOCALIZED STABILIZATION

(71) Applicant: Cole Astin, Los Angeles, CA (US)

(72) Inventor: Cole Astin, Los Angeles, CA (US)

( * ) Notice: Subject to any disclaimer, the term of this patent is extended or adjusted under 35 U.S.C. 154(b) by 540 days.

(21) Appl. No.: 14/224,688

(22) Filed: Mar. 25, 2014

(65) Prior Publication Data

US 2014/0289935 A1 Oct. 2, 2014

Related U.S. Application Data

(60) Provisional application No. 61/805,518, filed on Mar. 26, 2013.

(51) Int. Cl.
*A41B 9/02* (2006.01)

(52) U.S. Cl.
CPC ..... *A41B 9/02* (2013.01); *A41B 9/026* (2013.01)

(58) Field of Classification Search
CPC ..... A41B 9/02
USPC ..... 2/67, 227, 228, 238, 338, 400–405; 600/38, 41; 602/67
See application file for complete search history.

(56) References Cited

U.S. PATENT DOCUMENTS

| | | | |
|---|---|---|---|
| 496,747 | A | 5/1893 | Polock |
| 745,264 | A | 11/1903 | Todd |
| 1,020,588 | A | 3/1912 | West et al. |
| 1,119,944 | A | 12/1914 | Fritsch |
| 1,343,038 | A | 6/1920 | Czechowicz |
| 1,477,187 | A | 12/1923 | Rayne |
| 1,561,888 | A | 11/1925 | Stengel |
| 2,061,161 | A | 11/1936 | Chatfield |
| 2,114,634 | A | 4/1938 | Jean et al. |

(Continued)

FOREIGN PATENT DOCUMENTS

| | | |
|---|---|---|
| GB | 2055885 | 4/1997 |
| GB | 2055887 | 4/1997 |

OTHER PUBLICATIONS

Spicy Lingerie Inc., Panties Thongs, website address: http://www.spicylingerie.com/panties-thongs.html, Spicy Lingerie, Inc., Ontario, CA, USA.

(Continued)

*Primary Examiner* — Katherine Moran
(74) *Attorney, Agent, or Firm* — Thomas P. O'Connell; O'Connell Law Firm

(57) ABSTRACT

A phallus retention garment, such as a lower body underwear garment, with localized stabilization of a retained prosthetic phallus in relation to an underwear structure. A crotch portion with a phallus retention aperture can form a phallus retaining portion. The underwear structure has a body portion, a waistband secured to the body portion, and first and second leg openings formed in the body portion, all of which could be resiliently stretchable as could be the phallus retention aperture. One or more panels of substantially non-stretch or inelastic material can partially or completely surround the phallus retention aperture to provide localized stabilization. The garment structure can be formed with one or more layers of elastic material, and at least one layer of substantially inelastic material forming the stabilization portion can be fixed to the layer of elastic material adjacent to the phallus retention aperture, such as by stitching in a pattern.

27 Claims, 8 Drawing Sheets

(56) References Cited

U.S. PATENT DOCUMENTS

| | | | | |
|---|---|---|---|---|
| 2,264,934 | A | 12/1941 | Cronk | |
| 2,266,062 | A | 12/1941 | Montmarquet | |
| RE22,880 | E | 5/1947 | Morrison | |
| 2,427,428 | A | 9/1947 | Vitale et al. | |
| 2,686,517 | A | 8/1954 | Boyd et al. | |
| 4,195,630 | A | 4/1980 | Connery | |
| 4,453,541 | A | 6/1984 | Castelli et al. | |
| 4,471,772 | A | 9/1984 | Miller, Jr. | |
| 4,488,541 | A | 12/1984 | Garcia | |
| D281,013 | S | 10/1985 | Doyel | |
| 4,622,962 | A | 11/1986 | Kauffman | |
| 4,660,551 | A | 4/1987 | Nishimura | |
| 4,679,554 | A | 7/1987 | Markham | |
| 4,724,829 | A | 2/1988 | Knapps | |
| 4,759,355 | A | 7/1988 | Thrower | |
| 4,967,768 | A | 11/1990 | Tatro | |
| 4,989,592 | A | 2/1991 | Chang | |
| 5,103,810 | A | 4/1992 | Chang | |
| 5,172,430 | A * | 12/1992 | Lerma-Solis | A41B 9/02 128/842 |
| D338,543 | S | 8/1993 | Van Laar | |
| D378,947 | S | 4/1997 | Desmond | |
| 5,630,232 | A | 5/1997 | Miller et al. | |
| D401,341 | S | 11/1998 | Poubouridis | |
| 5,893,827 | A | 4/1999 | Jaquez et al. | |
| D410,742 | S | 6/1999 | Coolidge | |
| D410,959 | S | 6/1999 | Van Laar | |
| 6,123,664 | A | 9/2000 | Ard | |
| D444,616 | S | 7/2001 | Khan | |
| 6,332,862 | B1 | 12/2001 | Zandman | |
| 6,473,908 | B1 | 11/2002 | Bontems | |
| 6,547,717 | B1 | 4/2003 | Green et al. | |
| 6,553,574 | B1 | 4/2003 | Hall, Jr. et al. | |
| 6,662,378 | B2 | 12/2003 | Vartanyan | |
| 6,849,041 | B2 | 2/2005 | Astin | |
| D510,791 | S | 10/2005 | Nathan-Kohan | |
| 7,000,261 | B1 | 2/2006 | Loffredo | |
| 7,032,249 | B2 | 4/2006 | Smith | |
| 7,434,273 | B2 * | 10/2008 | Chung | A41B 9/023 2/403 |
| 7,676,853 | B1 | 3/2010 | Cutlip | |
| 7,762,262 | B1 | 7/2010 | Granja | |
| D632,459 | S | 2/2011 | Smith | |
| D640,040 | S | 6/2011 | Martin | |
| D646,462 | S | 10/2011 | Ellis et al. | |
| D651,377 | S | 1/2012 | Weaver et al. | |
| D652,944 | S | 1/2012 | deMouchet | |
| 8,109,869 | B2 | 2/2012 | Beaulieu | |
| D656,708 | S | 4/2012 | Ellis | |
| D664,326 | S | 7/2012 | Steele | |
| 8,230,526 | B2 | 7/2012 | Holland et al. | |
| 8,555,422 | B2 * | 10/2013 | Steele | A41B 9/023 2/400 |
| 2004/0199046 | A1 * | 10/2004 | Astin | A61F 5/40 600/38 |
| 2006/0277649 | A1 | 12/2006 | Smith | |
| 2007/0277285 | A1 | 12/2007 | Gravette et al. | |
| 2008/0010716 | A1 * | 1/2008 | Brown | A41B 9/023 2/78.1 |
| 2008/0109945 | A1 | 5/2008 | Xia | |
| 2010/0041943 | A1 | 2/2010 | Hovland et al. | |
| 2010/0058517 | A1 | 3/2010 | Perolari | |
| 2010/0300453 | A1 | 12/2010 | Wells | |
| 2011/0054251 | A1 | 3/2011 | Staffolani | |
| 2012/0178990 | A1 | 7/2012 | Astin | |
| 2012/0260404 | A1 | 10/2012 | Steele | |

OTHER PUBLICATIONS

JT's Stockroom, Bootie Cleavage Brief, website address: http://www.stockroom.com/Bootie-Cleavage-Brief-P2132.aspx, JT's Stockroom, Los Angeles, CA, USA.

Liberator, Inc., Valkyrie Two-Strap Harness, website address: http://www.liberator.com/valkyrie-two-strap-harness.html, Liberator, Inc., Atlanta, GA, USA.

Liberator, Inc., Valkyrie Bow Panty Harness, website address: http://www.liberator.com/valkyrie-bow--panty-harness.html, Liberator, Inc., Atlanta, GA, USA.

Stashitware, Pocket Underwear, website address: http://www.stashitware.com/Pocket_Brief.html, Stashitware LLC, Inc., Location unknown.

* cited by examiner

RESILIENT PHALLUS RETENTION GARMENT WITH LOCALIZED STABILIZATION

RELATED APPLICATION

This application claims priority to U.S. Provisional Patent Application No. 61/805,518, filed Mar. 26, 2013, which is incorporated herein by reference.

FIELD OF THE INVENTION

The present invention relates generally to apparatuses for retaining prosthetic phalluses. More particularly, disclosed and protected herein is a resilient phallus retention garment with localized stabilization of a retained prosthetic phallus.

BACKGROUND OF THE INVENTION

The prior art has disclosed numerous structures for retaining a phallus relative to a wearer's body. For example, various harnesses have been disclosed for retaining a phallus relative to the pelvis of a wearer.

Unfortunately, the harnesses and other arrangements of the prior art suffer from a number of limitations and disadvantages. Many commercially available harnesses are formed with a rigid crotch plate that is retained relative to a wearer by a similarly rigid belt arrangement. For example, in U.S. Pat. No. 4,488,541, Garcia discloses what is referred to as a Therapeutic Adapter wherein a pubic shield has a plurality of conical projections and a monolithically formed tubular portion. The pubic shield and the tubular portion are held in place by a system of waist and leg belts. In a similar vein, a Sexual Aid is disclosed in U.S. Pat. No. 5,103,810 to Chang wherein a tubular body is retained by a guard member and a connection piece. The device is retained in place by a waistband and bands coupled to the connection piece.

The structures taught by Garcia, Chang, and many other disclosures of the prior art can thus be seen to be quite rigid and unnatural in structure and application. While they may have the advantage of stably retaining a prosthetic phallus due to the rigidity of the pelvis and, often, the belt portions of the harness, such prior art harnesses can be uncomfortable and restrictive to the wearer.

The present inventor improved upon the previous state of the art with the retention arrangements disclosed in U.S. Pat. No. 6,849,041 for a Phallus Retention Harness and a plurality of subsequent improvements. Under the '041 patent, a phallus retention harness was disclosed with a pocket member with typically resilient front and rear panels and an aperture in the front panel that enables a prosthetic phallus to be retained relative to a user in a comfortable yet effective manner not only during sexual encounters but also as during normal daily activities in an inconspicuous manner under a wearer's clothing if so desired. The invention of the '041 patent has achieved widespread commercial success and has been embodied, for instance, in resilient undergarments approximating the general configuration of underwear briefs, boxers, and panties.

While advantageous for its comfort, adjustability, and conformability, the resiliency of harnesses taught and permitted under the '041 patent, without more, leaves the base of the prosthetic phallus retained by a panel or panels of resilient material, such as varied compositions of spandex. This results in a lack of ideal stability. Conversely, the retaining retention harness could be crafted from non-resilient material, but the desired advantages of for instance, comfort and conformability would be lost.

The present inventor has thus recognized that it would be advantageous to provide a phallus retention harness that simultaneously adhieves the typically competing goals of exhibiting flexibility where desirable, such as in relation to a wearer's waist and legs, while providing stable localized support to a retained prosthetic phallus.

SUMMARY OF THE INVENTION

With a knowledge of the present state of the art, the present inventor set forth with the basic object of providing stable localized support to a retained prosthetic phallus in a phallus retention garment.

A further object of the invention is to provide a phallus retention garment that exhibits flexibility where desirable, such as in relation to a wearer's waist, hips, bottom, and legs.

An additional object of the invention is to provide a phallus retention garment capable of retaining a prosthetic phallus in an erect and stable manner both in use and not.

A more particular object of embodiments of the invention is to provide a phallus retention garment that resists unintended localized stretching of the retaining panel and resultant sagging and leaning of the retained prosthetic phallus.

Still another object of embodiments of the invention is to provide a phallus retention garment that tends to prevent a prosthetic phallus from excessive flopping about and pulling away from the wearer during use.

These and further objects and advantages of the present invention will become obvious not only to one who reviews the present specification and drawings but also to those who have an opportunity to experience an embodiment of the resilient phallus retention garment with localized stabilization of a retained prosthetic phallus disclosed herein in operation. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth one more objects of the invention, an embodiment of the resilient phallus retention garment with localized stabilization of a retained prosthetic phallus can be considered to be founded on a garment structure for being retained relative to a body of a wearer. The garment structure has a resiliently stretchable portion and a phallus retaining portion. A phallus retaining aperture is disposed in the phallus retaining portion for receiving a prosthetic phallus, and a stabilization portion is retained by the garment structure adjacent to the phallus retaining aperture. With that, the stabilization portion provides stabilization to a phallus disposed through the phallus retention aperture to avoid inadvertent displacement, flopping, or other unintended movement of the prosthetic phallus.

The garment can, but need not, be a lower body underwear garment with the garment structure comprising a lower body underwear structure. In such an embodiment, a crotch portion can comprise the phallus retaining portion, and the phallus retention aperture can be disposed in the crotch portion. The underwear structure can have a body portion, a waistband secured to the body portion, and first and second leg openings formed in the body portion. The waistband and, potentially, the first and second leg openings can be formed from a resiliently stretchable material to permit free and comfortable movement of the user's waist, legs, and torso.

At least one, or possibly two, flaps can be retained relative to the crotch portion, such as behind the phallus retention aperture, to overlie the phallus retention aperture. With that, the base of a prosthetic phallus can be retained in place between the flap or flaps and the crotch portion of the body portion. In a further refinement, at least one pocket can be coupled to the crotch portion adjacent to the phallus retention aperture, such as for holding a vibratory device or other article. Moreover, a tie-down strap, potentially of elastic band material, can have first and second ends coupled to the crotch portion adjacent to the phallus retention aperture. To facilitate the stable yet flexible retention of a prosthetic phallus, the phallus retention aperture can be defined by resiliently stretchable material.

In certain embodiments, the stabilization portion can be formed by at least one panel of substantially non-stretch or inelastic material. The at least one panel of substantially non-stretch material can partially or substantially entirely surround the phallus retention aperture.

Manifestations of the garment could have the garment structure formed with at least one layer of elastic material, and the stabilization portion can be carried forth with at least one layer of substantially inelastic material fixed to the layer of elastic material adjacent to the phallus retention aperture. By way of example, the at least one layer of substantially inelastic material could be fixed to the layer of elastic material by stitching in a pattern. In still more particular embodiments, the garment structure can have at least first and second layers of elastic material, and the at least one layer of substantially inelastic material can be fixed at least partially between the first and second layers of elastic material.

While the phallus retention garment could take many forms, it is contemplated that it could be embodied as a lower body underwear structure. As such, it could have a crotch portion that forms the phallus retaining portion, and the phallus retention aperture can be disposed in the crotch portion. A waistband can be secured to the body portion, and first and second leg openings can be formed in the body portion. Where the stabilization portion comprises at least one layer of inelastic material, it can terminate spaced from the first and second leg openings, and the body portion of the underwear structure can be formed with at least one layer of elastic material to permit the desired flexibility of the garment.

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

The resilient phallus retention garment with localized stabilization of a retained prosthetic phallus disclosed herein is subject to a wide variety of embodiments. However, to ensure that one skilled in the art will be able to understand and, in appropriate cases, practice the present invention, certain preferred embodiments of the broader invention revealed herein are described below and shown in the accompanying drawing figures.

Figure 1:
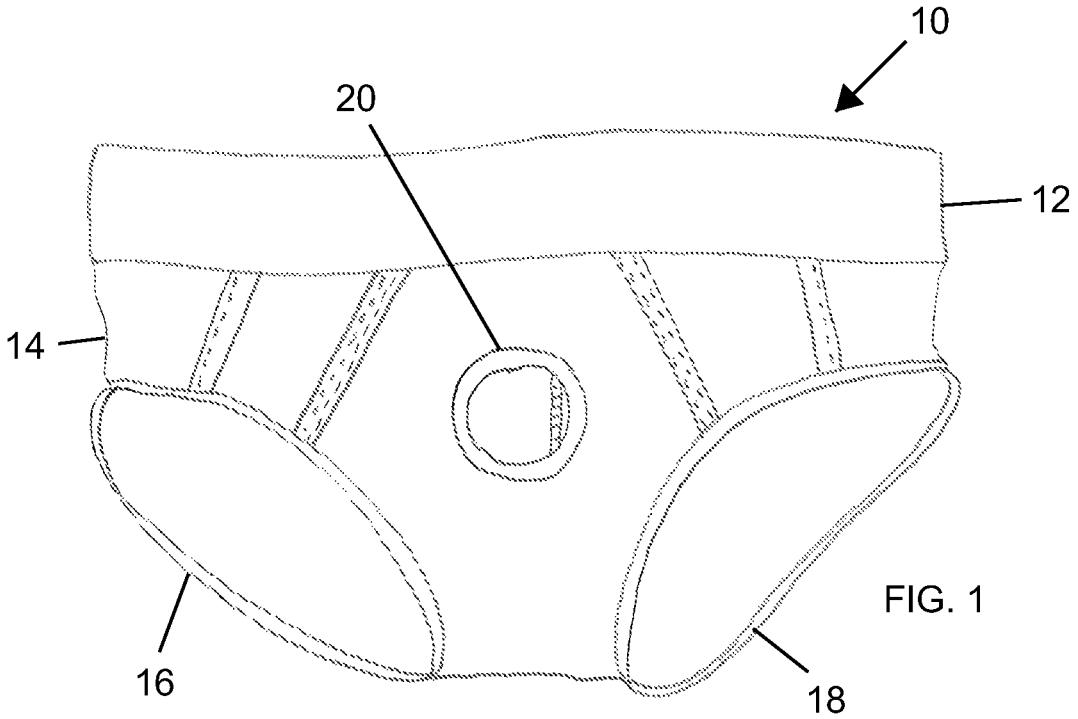
FIG. 1 is view in front elevation of a resilient phallus retention garment with localized stabilization of a retained prosthetic phallus as taught herein.
Figure 2:
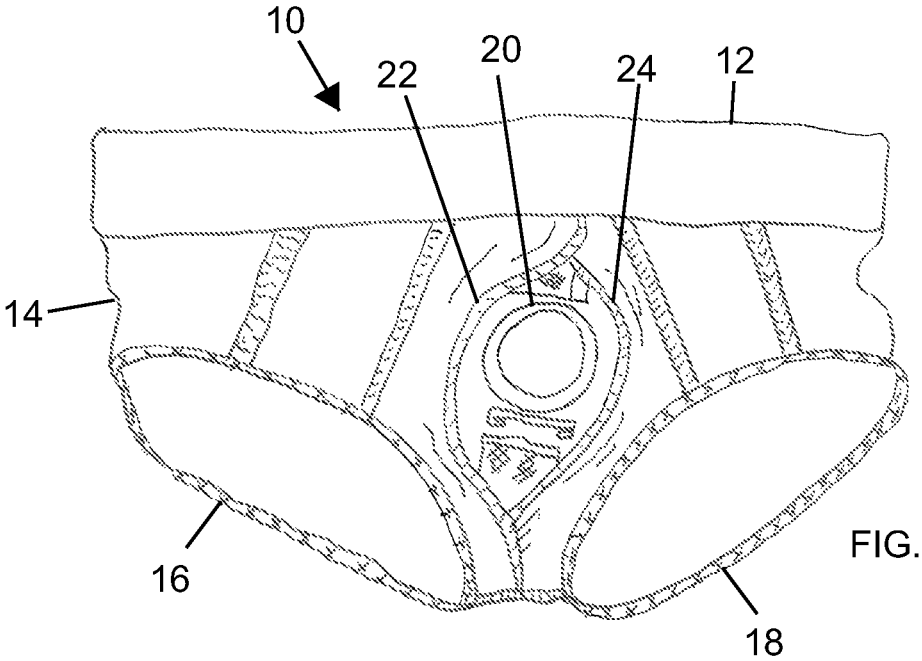
FIG. 2 is view in front elevation of the resilient phallus retention garment with localized stabilization of FIG. 1 in an inside-out configuration and with the rear flaps thereof opened.

Turning more particularly to the drawings, a resilient phallus retention garment with localized stabilization of a retained prosthetic phallus according to the present invention is indicated generally at 10 in FIGS. 1 and 2. There, the phallus retention garment 10 has a waistband 12, a body portion 14, and first and second leg openings 16 and 18. In this example, the phallus retention garment 10 is configured as an underwear brief garment, but the invention is, of course, not so limited. Embodiments of the phallus retention garment 10 could take numerous different forms, including, by way of example and not limitation, boxer briefs, panties, athletic supporters, and other types of garments, which may or may not be retained relative to a wearer's crotch.

Figure 3:
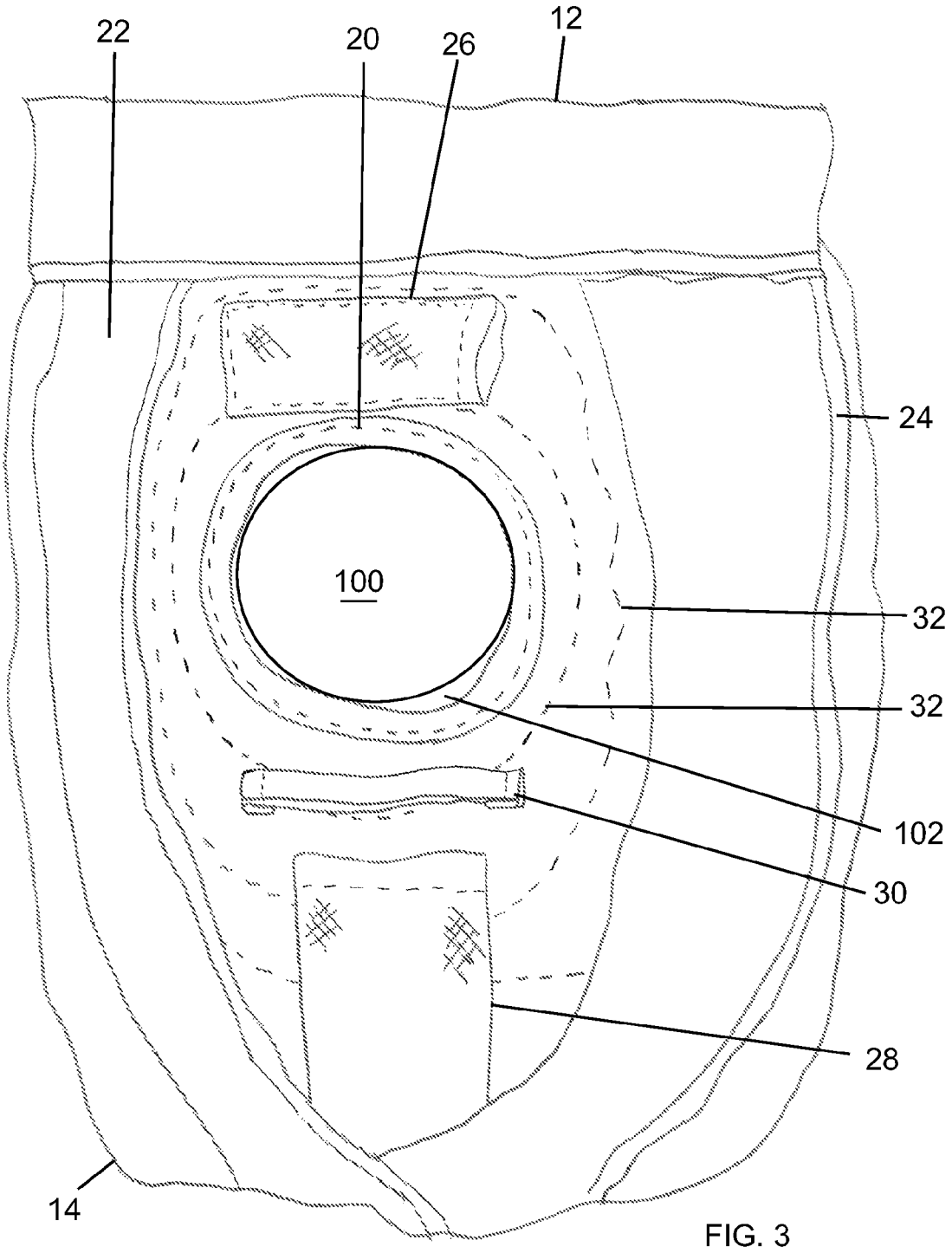
FIG. 3 is an enlarged view in front elevation of the phallus retention portion of the resilient phallus retention garment of FIG. 1.

The garment 10 has a phallus retaining portion that is, in this example, disposed in the crotch of the garment 10. The phallus retaining portion of the garment 10 has a phallus retaining aperture 20. As shown in FIG. 3, during use of the phallus retention garment 10, the shaft of a prosthetic phallus 100 can be received through the phallus retaining aperture 20, potentially with a base 102 of the prosthetic phallus 100 preventing it from inadvertently dislodging. As shown in FIG. 2 where the garment 10 is shown inside out, first and second flaps 22 and 24 can close behind the phallus retention aperture 20 and can be selectively opened to enable installation and removal of the prosthetic phallus 100.

As seen in FIG. 3, an upper pocket 26 can be disposed above the phallus retention aperture 20 for retaining, among other things, a stimulation aid, such as a vibratory stimulation aid. To a similar end, a lower pocket 28 can be disposed below the phallus retention aperture 20. Moreover, a tie-down strap 30 can be interposed between the phallus retention aperture 20 and the lower pocket 28, such as for downwardly biasing a retained prosthetic phallus 100.

To permit the phallus retention garment 10 to be worn comfortably and with a measure of adaptability about a wearer's waist, the waistband 12 is resilient, such as by being formed of an elastic band material. Likewise, the leg openings 16 and 18 may preferably be resilient, such as by being formed of an elastomeric or other resiliently stretchable material, to permit comfort and movement relative to the wearer's legs. Still further, the phallus retention aperture 20 is resilient, such as by being formed of an elastomeric or other resiliently stretchable woven or non-woven material, to permit an accommodation of differently sized prosthetic phalluses 100 and to contribute to the stable retention thereof.

While the leg openings 16 and 18, the waistband 12, and the phallus retention aperture 20 are or may be resilient, such as by being formed of resilient material, the phallus retention garment 10 achieves stable retention of a prosthetic phallus 100 by forming the area surrounding the phallus retention aperture 20 with stabilization. In the depicted example, the stabilization is achieved by one or more stabilization panels of material that is inelastic and substantially not stretchable and that is disposed adjacent to or surrounding the phallus retention aperture 20. The inelastic material can be a flexible woven or non-woven material, such as a plain-woven cotton or similar fabric or some other material resists substantial rapid stretching. It will be understood, however, that nearly any fabric or other flexible material, even heavy canvas or tightly woven cotton, will exhibit marginal stretching when placed under stress, and such marginal stretching characteristics should be considered to be within the scope of the present disclosure's use of the terms and phrases "inelastic", "substantially not stretchable", "non-stretch", and similar descriptions.

To permit the desired resiliency of the leg openings 16 and 18, the waistband 12, and the phallus retention aperture 20, the substantially inelastic stabilization panel or panels may be spaced from, such as by terminating short of or without reaching, some or all of the leg openings 16 and 18, the waistband 12, and the phallus retention aperture 20. By way of example, the substantially inelastic panel or panels may terminate inboard of or spaced inwardly from one of, some of, or each of the leg openings 16 and 18, the waistband 12, and the phallus retention aperture 20. The material or materials establishing one of, some of, or each of the leg openings 16 and 18, the waistband 12, and the phallus retention aperture 20 can itself be elastic and resilient.

The substantially inelastic panel may, but need not necessarily, be overlapped with one or more additional panels, which may or may not be elastic or resiliently stretchable. Alternatively, it would be possible to attach elastic material or materials edgewise to the substantially inelastic stabilization panel to form one or more of the leg openings 16 and 18, the waistband 12, and the phallus retention aperture 20. With that, the phallus retention garment 10 could have an inelastic panel or panels providing the desired stability around the phallus retention aperture 20 with overlapping or edgewise connected elastically resilient portions providing the desired resiliency and elasticity around one, some or all of the leg openings 16 and 18, the waistband 12, and the phallus retention aperture 20.

Figure 4:
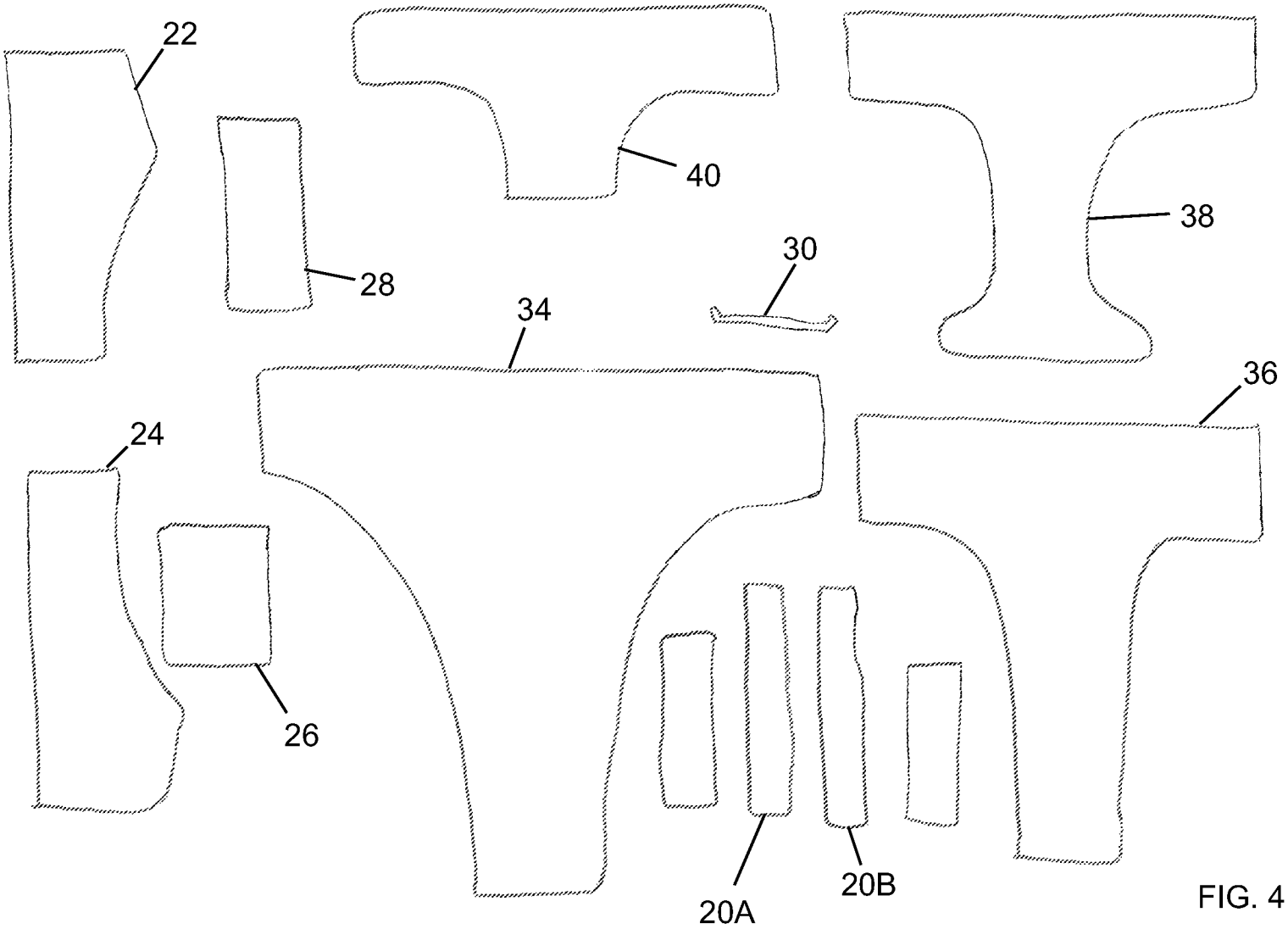
FIG. 4 is a top plan view of the components of the phallus retention portion of the resilient phallus retention garment of FIG. 1 prior to assembly.
Figure 5:
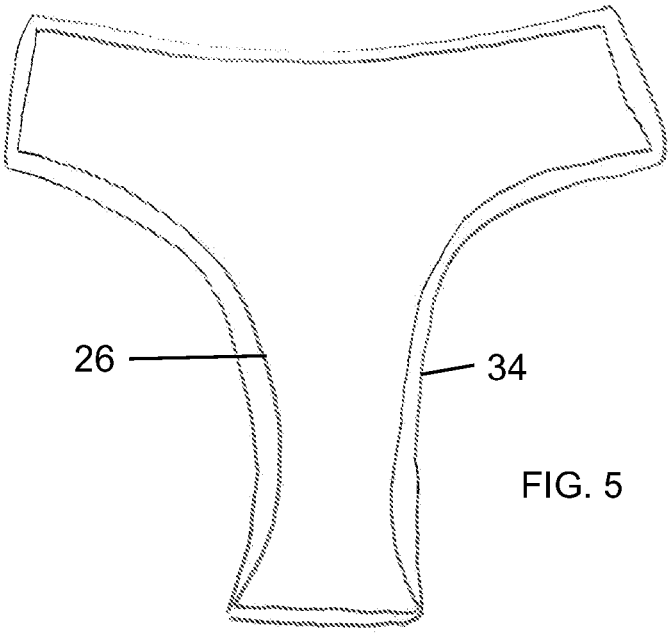
FIG. 5 is a top plan view of a resilient layer and a stabilizing layer as taught herein.
Figure 6:
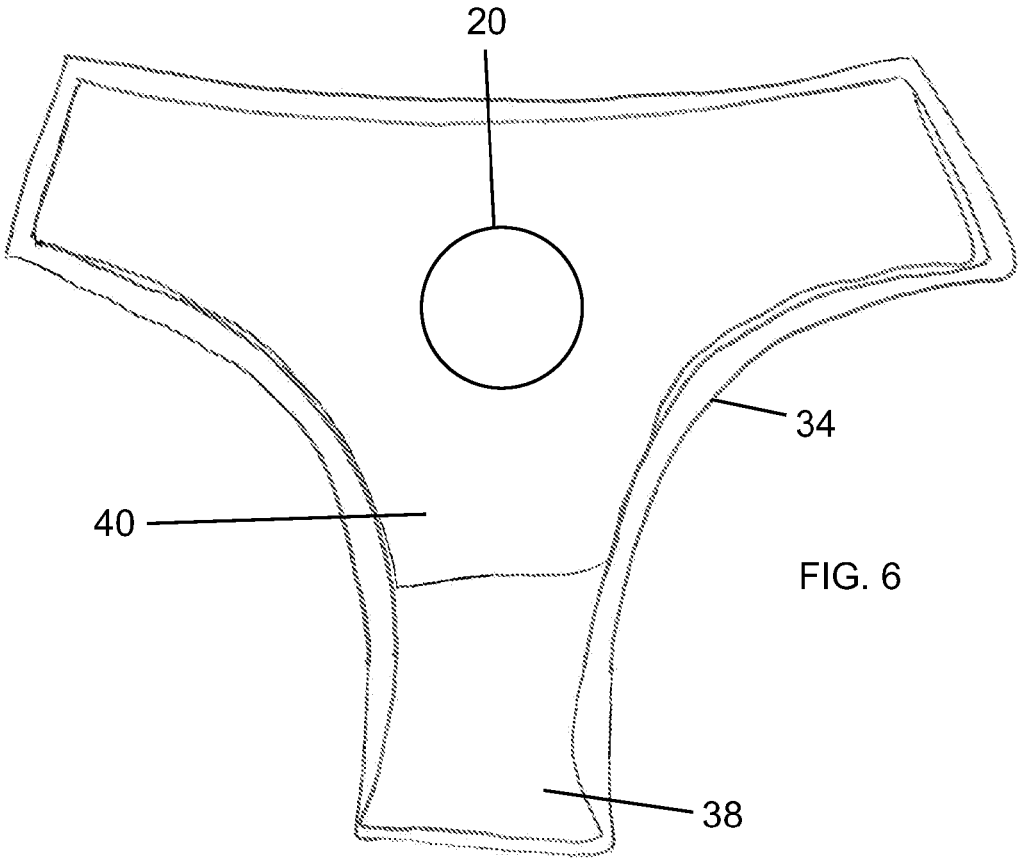
FIG. 6 is a top plan view of a resilient layer and first and second stabilizing layers as taught herein.
Figure 7:
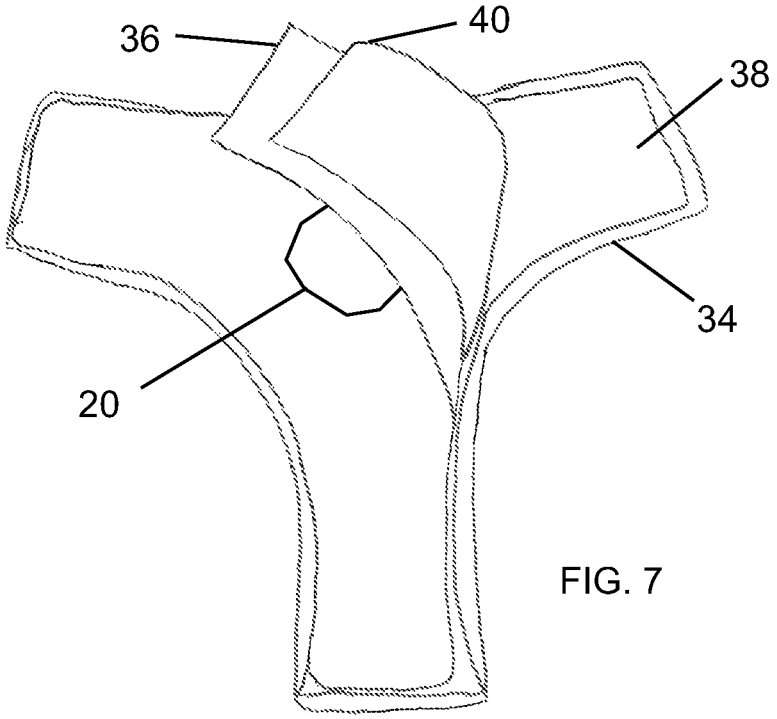
FIG. 7 is a top plan view of a resilient layer, first and second stabilizing layers, and a resilient layer as taught herein.
Figure 8:
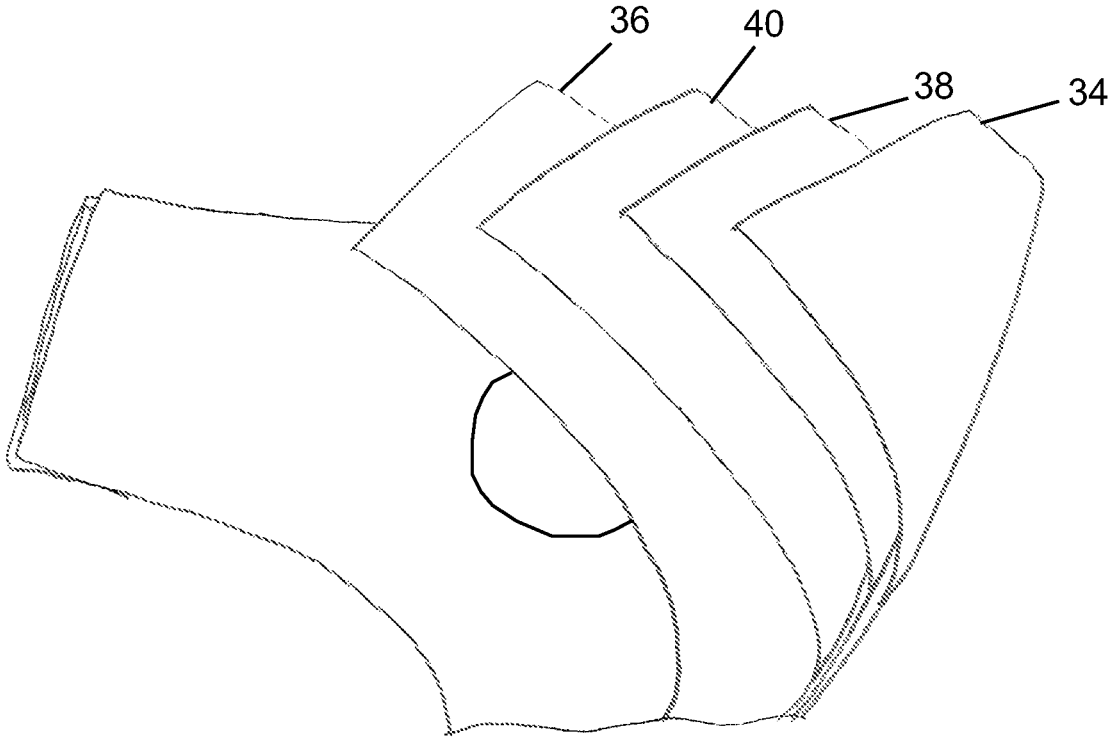
FIG. 8 is an enlarged top plan view of the resilient layer, first and second stabilizing layers, and the resilient layer as taught herein.

The phallus retention portion of the garment 10 in one presently contemplated embodiment can be formed by an assemblage of parts, such as the assemblage of parts shown in FIG. 4. There, the phallus retention portion has panels or layers 34 and 36 of resilient, elastic material shaped corresponding to the crotch of a wearer and the crotch of the resulting garment 10. Panels or layers 38 and 40 of substantially inelastic material substantially correspond to the shape of the layers 34 and 36 of elastic, resilient material but are marginally smaller. As a result, the edges of the layers 38 and 40 are inwardly can be spaced from or inboard of the edges of the resilient material layers 34 and 36 when the layers 34, 36, 38, and 40 are caused to overlap as illustrated in FIGS. 5 through 8. In practice, the layers or panels 34, 36, 38, and 40 can be disposed with the elastic material panel 34 forming an inner layer, the elastic material panel 36 forming an outer layer and the inelastic panels or layers 38 and 40 interposed therebetween. It would be possible for the panels 34, 36, 38, and 40 to be substantially similar in shape and size and for the desired stabilization and elasticity achieved hereunder to be realized by selectively securing the panels 34, 36, and 38, and 40 as taught herein with portions of some or all of the leg openings 16 and 18, the waistband 12, and the phallus retention aperture 20 formed by elastic material and not restrained by the panels 38 and 40 of inelastic material.

Again referring to FIG. 4, panels 22 and 24, which can be of elastic material, are provided to form the first and second flaps 22 and 24. Panels 26 and 28, which could for instance be of an elastomeric mesh or any other material, are to be attached to form the pockets 26 and 28, and the resilient strip 30, which can be of elastic band material, can be attached to form the hold-down strap 30. Still further, pieces of material 20A and 20B, which can be elastic and resilient, can be shaped and secured to define the periphery of the phallus retention aperture 20 when a corresponding through-hole 20 is formed in the layers 34, 36, 38, and 40. The several components can be fastened together as by sewing or any other effective method.

Figure 9:
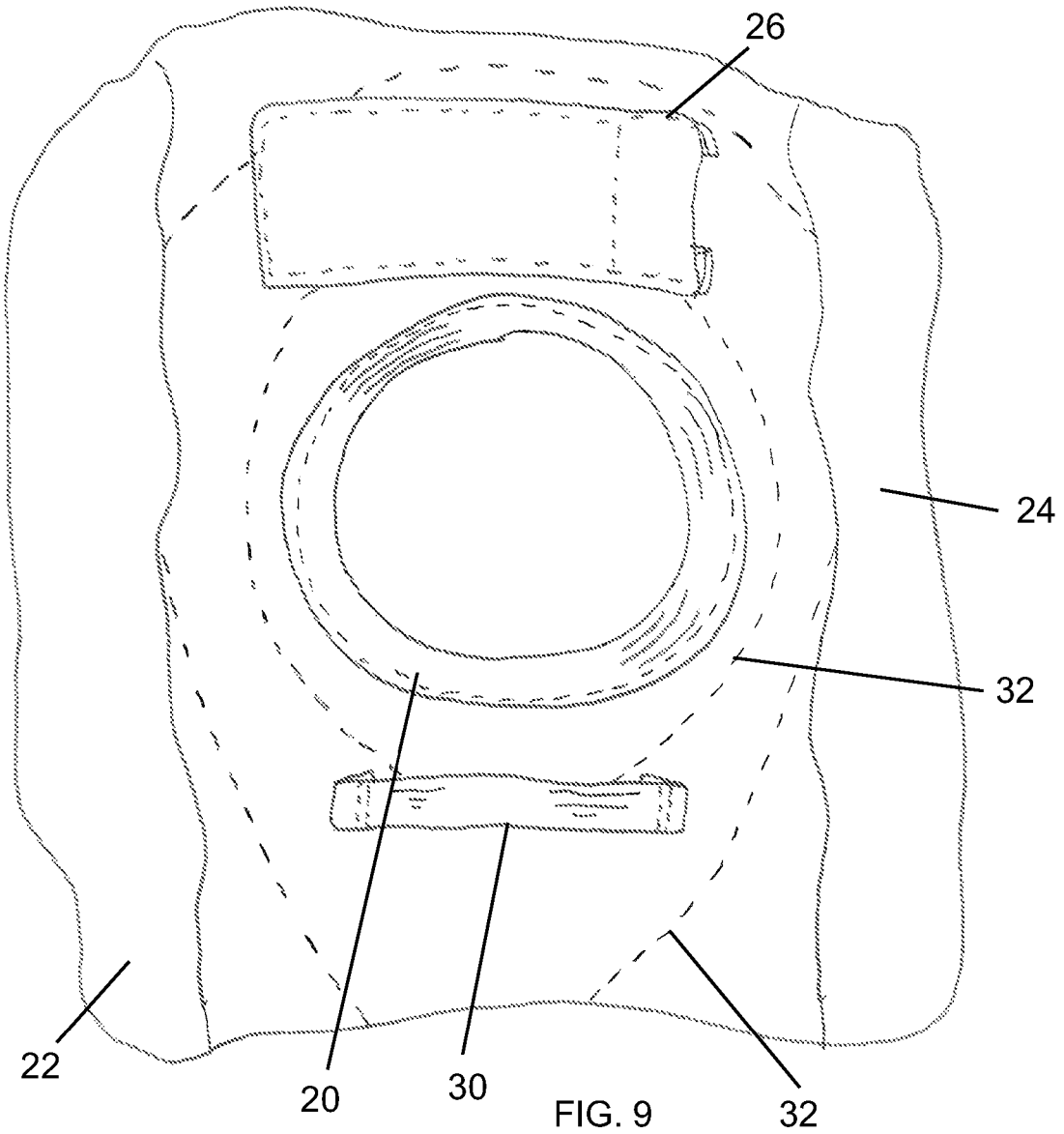
FIG. 9 is a further enlarged view in front elevation of the phallus retention portion of the resilient phallus retention garment of FIG. 1.

As FIG. 9 shows perhaps most clearly, the substantially inelastic layers 38 and 40 can be secured in place between the elastic layers 34 and 36 over some or all of the portions of the layers 34, 36, 38, and 40 along and, additionally or alternatively, inside or inboard of the edges of the non-resilient layers 38 and 40. The securing of the layers 34, 36, 38, and 40 could be carried out in any effective manner, including by way of example and not limitation adhesive, fasteners, stitching, or any other method. In this non-limiting example, a pattern of stitching 32 secures the substantially non-resilient layers 38 and 40 in place between the resilient layers 34 and 36. Stitching pattern 32 could, for example, travel adjacent to the edges of the substantially inelastic layers 38 and 40 and otherwise within the area of the substantially inelastic layers 38 and 40 to join the several layers 34, 36, 38, and 40. With that, the overlapping portions of the layers 34, 36, 38, and 40 stitched together, potentially with boundaries, designs, or any other pattern 32, will be rendered inelastic and will be stabilized. Portions of the elastic layers 34 and 36 not so stabilized and rendered elastic will remain elastic. Where the stitching pattern 32 and, potentially, the substantially inelastic layers 38 and 40 have edges spaced inwardly of the edges of the elastic layers 34 and 36 and other resilient components forming the leg openings 16 and 18, the waistband 12, and the phallus retention aperture 20, those portions of the garment 10 remain elastic while the substantially inelastic layers 38 and 40 provide the desired stability to the retained prosthetic phallus 100, such as in areas between the leg openings 16 and 18, the waistband 12, and the phallus retention aperture 20.

It would be possible to provide a substantially inelastic layer or layers elsewhere in the garment 10, and that layer or layers could be similarly spaced and secured. However, it may be that the inelastic layer is only required in the front of the garment 10 since that is where the prosthetic phallus 100 is to be retained. Having the back and other areas of the garment 10 without the inelastic layers permits the garment 10 to sit and function as an undergarment normally would thereby making it more comfortable for the wearer.

Figure 10:
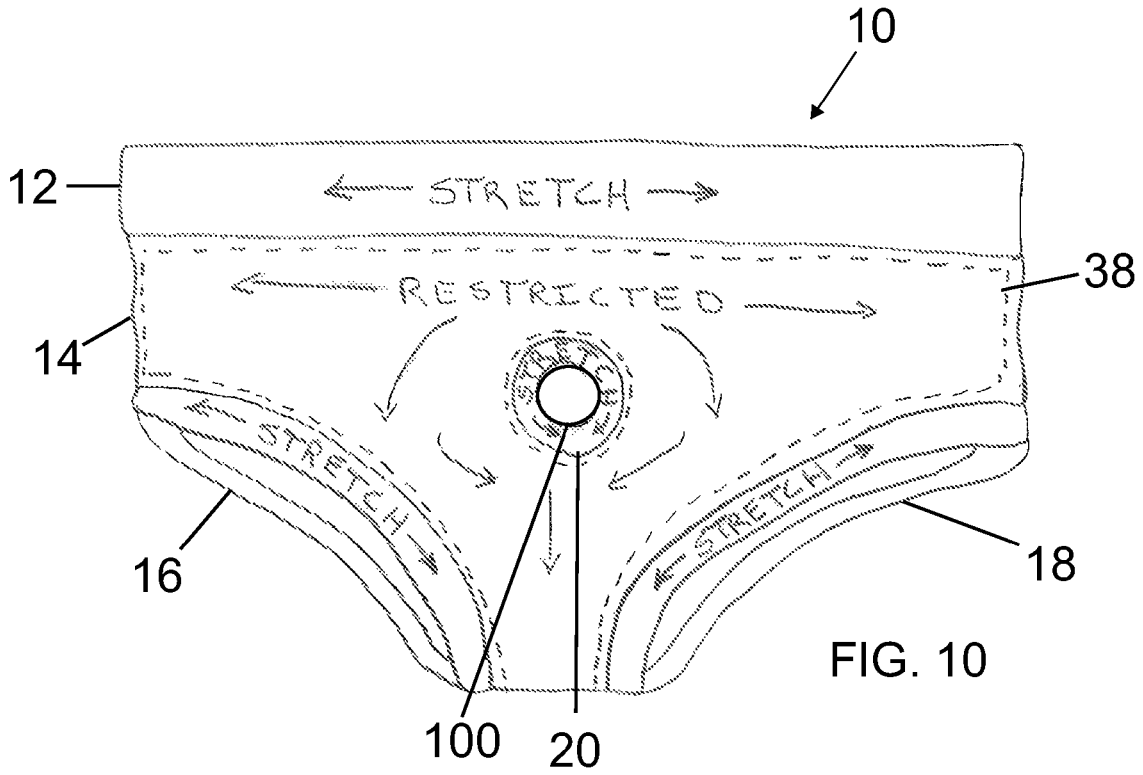
FIG. 10 is a schematic view in front elevation of a resilient phallus retention garment as taught herein.

The schematic depiction of the garment 10 of FIG. 10 illustrates the effects of the elastic and inelastic portions of the garment 10 most graphically. There, the leg openings 16 and 18, the waistband 12, and the phallus retention aperture 20, can be seen to be of stretch material to permit multi-directional stretching and flexibility about the wearer's waist and legs and about the prosthetic phallus. Simultaneously, by operation of the inelastic stabilization panels 38 and 40, the area surrounding the phallus retention aperture 20 is restricted against stretching, even with the inner and outer layers 34 and 36 comprising elastic material. With that, comfortable wear and movement within the phallus retention garment 10 is permitted while a phallus 100 retained in relation to the phallus retention aperture 20 is stabilized against undesirable displacement, flopping, and other unintended movement relative to the wearer's body.

It will again be noted that phallus retention garments 10 can vary widely in structure within the scope of the disclosed invention. One alternative phallus retention garment is again indicated at 10 in FIG. 11. There, the garment 10 takes the form of boxer brief underwear. As such, the phallus retention garment 10 has a resilient waistband 12, a body portion 14, and first and second tubular leg portions 16 and 18. Here, however, there are first and second phallus retention apertures 20A and 20B in a top and bottom configuration such that first and second phalluses (not shown) can be received through the apertures 20A and 20B. In such uses of the garment 10, both phalluses could be prosthetic. In other uses, one phallus could be prosthetic and one could be human.

Figure 11:
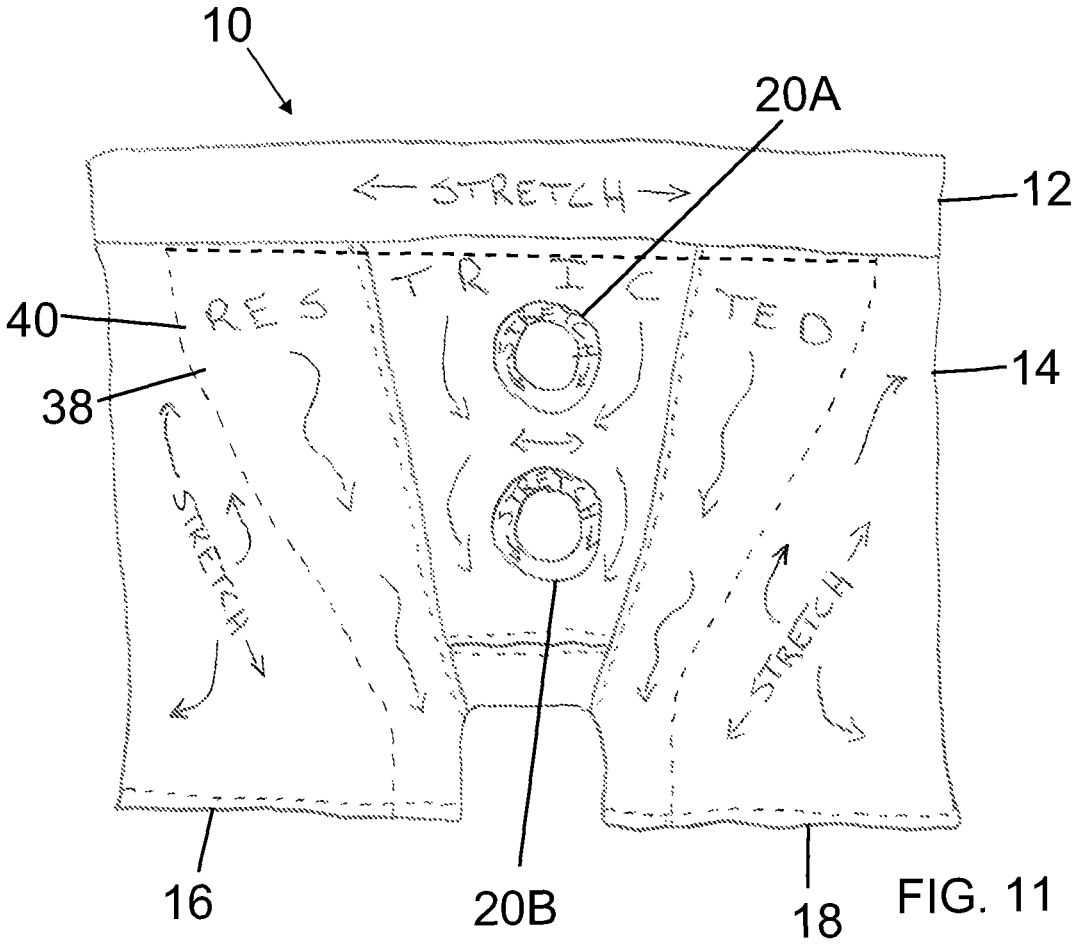
FIG. 11 is a schematic view in front elevation of an alternative resilient phallus retention garment as taught herein.

In FIG. 11, the effects of the elastic and inelastic portions of the garment 10 are again depicted. The waistband 12, the phallus retention apertures 20A and 20B, and at least a portion of each of the leg portions 16 and 18 can be seen to be of stretch material to permit multi-directional stretching and flexibility about the wearer's waist, hips, bottom, and legs and about the phalluses. Here, the inelastic stabilization panels 38 and 40 surround the phallus retention apertures 20A and 20B and traverse from adjacent to, but spaced from, the waistband 12, to the lower ends of the leg portions 16 and 18. The stabilization panels 38 and 40 have lateral edges, which are secured to the elastic leg and body portions 16, 18, and 14, that terminate inboard of the hip and outer leg portions of the garment 10. More particularly, the outboard, lateral edges of the stabilization panels 38 and 40 follow an upper portion of an hourglass shape. With that, the area surrounding the apertures 20A and 20B is restricted against stretching while the waist, seat, hip, and leg portions 16 and 18 are resiliently stretchable as is the area immediately defining each aperture 20A and 20B. With that, comfortable wear and movement within the phallus retention garment 10 is permitted while phalluses retained in relation to the phallus retention apertures 20A and 20B are stabilized against undesirable displacement, flopping, and other unintended movement relative to the wearer's body.

Of course, the exact configuration and relationships of the panels 34, 36, 38, and 40 and other components can vary within the teachings of the invention. In one example, the inelastic panels or layers 38 and 40 can be attached below the waistband 12, travel from the left to right in the front of the garment 10 with an aperture 20 formed for receiving the phallus, and end approximately ¼ to ½ inch from the bottom of the garment 10.

The material forming the substantially inelastic panels 38 and 40 will preferably be similar enough in wear and use to the elastic materials of the garment 10 so that it can move, wear and shrink or not shrink at the same rate as the other fabrics to maintain the integrity of the product and support thereof. The elastic material can be a knit and can be any resiliently stretchable material, including by way of example, cotton, nylon, canvas, modal, polyester, and any other suitably resilient material or combination thereof. Materials may incorporate added elastomeric material, such as spandex, elastane, and rayon. The substantially inelastic material could, for example, be any substantially non-resilient, non-stretch material and could, for example but not by way of limitation, be cotton, nylon, canvas, modal, polyester, nylon, or any other material or combination thereof that substantially avoids stretching. Of course, substantially any of the foregoing inelastic materials will be subject to some stretching when under stress, but the chosen material should be substantially inelastic. The number of layers depicted herein are merely exemplary. It would be possible to include further or fewer layers of elastic and inelastic material in each instance.

With certain details and embodiments of the present invention for a resilient phallus retention garment 10 with localized stabilization of a retained prosthetic phallus disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall define the scope of protection to be afforded to the inventor. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, any such claims shall be construed to cover not only the corresponding structure and material expressly described in this specification but also all equivalents thereof.

I claim as deserving the protection of Letters Patent:

1. A prosthetic phallus retention garment with localized stabilization of a retained prosthetic phallus, the garment comprising:

a garment structure for being retained relative to a body of a wearer;

a phallus retention portion in the garment structure wherein the phallus retention portion comprises at least one panel of elastic material;

a phallus retention aperture in the at least one panel of elastic material of the phallus retention portion for receiving a prosthetic phallus wherein the phallus retention aperture has a periphery;

a localized stabilization portion retained by the garment structure adjacent to the phallus retention aperture wherein the localized stabilization portion comprises at least one panel of substantially inelastic material that substantially entirely surrounds the phallus retention aperture; and an aperture in the at least one panel of substantially inelastic material in alignment with the phallus retention aperture in the at least one panel of elastic material;

wherein the at least one panel of elastic material of the phallus retention portion and the at least one panel of substantially inelastic material are secured together in an overlapping relationship;

whereby the stabilization portion provides stabilization to a prosthetic phallus disposed through the phallus retention aperture.

2. The prosthetic phallus retention garment of claim 1 wherein the garment structure comprises a lower body underwear structure with a crotch portion comprising the phallus retention portion and wherein the phallus retention aperture is disposed in the crotch portion.

3. The prosthetic phallus retention garment of claim 2 wherein the underwear structure has a body portion, a waistband secured to the body portion, and first and second leg openings formed in the body portion.

4. The prosthetic phallus retention garment of claim 3 wherein the waistband is formed from a resiliently stretchable material and wherein the first and second leg openings are formed with at least a portion of the first and second leg openings of a resiliently stretchable material.

5. The prosthetic phallus retention garment of claim 1 wherein the at least one panel of substantially inelastic material is fixed to the layer of elastic material by stitching in a pattern.

6. The prosthetic phallus retention garment of claim 1 wherein the phallus retention portion comprises at least first and second panels of elastic material and wherein the at least one panel of substantially inelastic material is secured between the first and second panels of elastic material in an overlapping relationship.

7. The prosthetic phallus retention garment of claim 6 wherein the garment structure comprises a lower body underwear structure with a crotch portion comprising the phallus retention portion and wherein the phallus retention aperture is disposed in the crotch portion.

8. The prosthetic phallus retention garment of claim 1 wherein the garment structure comprises a lower body underwear structure with a body portion, a crotch portion in the body portion, a waistband secured to the body portion, and first and second leg openings formed in the body portion, and wherein the phallus retention aperture is disposed in the crotch portion.

9. The prosthetic phallus retention garment of claim 8 wherein the at least one panel of inelastic material terminates spaced from at least a portion of the first and second leg openings and wherein the body portion of the underwear structure is formed with at least one panel of elastic material.

10. The prosthetic phallus retention garment of claim 1 wherein the at least one panel of elastic material of the phallus retention portion and the at least one panel of substantially inelastic material are secured together in a pattern wherein the pattern is spaced from the periphery of the phallus retention aperture.

11. The prosthetic phallus retention garment of claim 10 wherein the pattern includes a ring of stitching that surrounds the phallus retention aperture.

12. The prosthetic phallus retention garment of claim 1 wherein the at least one panel of elastic material of the phallus retention portion has a peripheral shape and wherein the at least one stabilization panel has a peripheral shape that corresponds to, but is marginally smaller than, the peripheral shape of the at least one panel of elastic material of the phallus retention portion wherein the at least one panel of elastic material and the at least one stabilization panel are secured with the peripheral shape in overlapping alignment whereby the at least one stabilization panel has edges that are inwardly spaced from edges of the at least one panel of elastic material of the phallus retention portion.

13. The prosthetic phallus retention garment of claim 12 wherein the phallus retention portion has first and second panels of elastic material and wherein the at least one stabilization panel is secured between the first and second panels of elastic material with the edges of the at least one stabilization panel spaced inwardly from edges of the first and second panels of elastic material.

14. The prosthetic phallus retention garment of claim 13 wherein the first and second panels of elastic material of the phallus retention portion and the at least one stabilization panel are secured together by stitching in a pattern that travels adjacent to the edges of the at least one stabilization panel and spaced inwardly from the edges of the first and second panels of elastic material.

15. A prosthetic phallus retention underwear garment with localized stabilization of a retained prosthetic phallus, the phallus retention underwear garment comprising:

a lower body underwear structure with a body portion, a waistband secured to the body portion, and first and second leg openings formed in the body portion wherein at least part of the lower body underwear structure is formed from a resiliently stretchable material;

a crotch portion disposed in the body portion wherein the crotch portion comprises at least one panel of elastic material;

a phallus retention aperture disposed in the at least one panel of elastic material of the crotch portion for receiving a prosthetic phallus wherein the phallus retention aperture has a periphery;

at least one stabilization panel of substantially inelastic material fixed to the body portion adjacent to the phallus retention aperture wherein the at least one stabilization panel substantially entirely surrounds the phallus retention aperture;

an aperture in the at least one stabilization panel in alignment with the phallus retention aperture in the at least one panel of elastic material;

wherein the at least one panel of elastic material of the phallus retention portion and the at least one stabilization panel are secured together in an overlapping relationship;

whereby the at least one stabilization panel provides stabilization to a prosthetic phallus disposed through the phallus retention aperture.

16. The prosthetic phallus retention underwear garment of claim 15 wherein the waistband is formed from a resiliently stretchable material.

17. The prosthetic phallus retention underwear garment of claim 15 wherein the first and second leg openings are formed with at least a portion of the first and second leg openings of a resiliently stretchable material.

18. The prosthetic phallus retention underwear garment of claim 15 wherein the at least one stabilization panel is fixed to the at least one panel of elastic material by stitching in a pattern.

19. The prosthetic phallus retention underwear garment of claim 15 wherein the body portion of the lower body underwear structure comprises at least first and second panels of elastic material and wherein the at least one stabilization panel is fixed at least partially between the first and second panels of elastic material in an overlapping relationship.

20. The prosthetic phallus retention underwear garment of claim 15 wherein the first and second leg openings are formed from a resiliently stretchable material and wherein the at least one stabilization panel terminates spaced from at least a portion of the first and second leg openings.

21. The prosthetic phallus retention underwear garment of claim 14 wherein the pattern is spaced from the periphery of the phallus retention aperture.

22. The prosthetic phallus retention underwear garment of claim 15 wherein the at least one stabilization panel terminates spaced from the waistband, the first and second leg openings, and the periphery of the phallus retention aperture.

23. The prosthetic phallus retention underwear garment of claim 22 wherein the at least one panel of elastic material has a peripheral shape and wherein the at least one stabilization panel has a peripheral shape that corresponds to, but is marginally smaller than, the peripheral shape of the at least one panel of elastic material wherein the at least one panel of elastic material and the at least one stabilization panel are secured with the peripheral shape in overlapping alignment whereby the at least one stabilization panel has edges that are inwardly spaced from edges of the at least one panel of elastic material.

24. The prosthetic phallus retention underwear garment of claim 23 wherein the crotch portion has first and second panels of elastic material and wherein the at least one stabilization panel is secured between the first and second panels of elastic material with the edges of the at least one stabilization panel spaced inwardly from edges of the first and second panels of elastic material.

25. The prosthetic phallus retention underwear garment of claim 24 wherein the first and second panels of elastic material of the phallus retention portion and the at least one stabilization panel are secured together by stitching in a pattern that travels adjacent to the edges of the at least one stabilization panel and spaced inwardly from the edges of the first and second panels of elastic material.

26. The prosthetic phallus retention underwear garment of claim 25 wherein the pattern includes a ring of stitching that surrounds the phallus retention aperture.

27. The prosthetic phallus retention underwear garment of claim 23 wherein the at least one stabilization panel has lateral edges that follow an upper portion of an hourglass shape.

* * * * *